US010960690B2

(12) United States Patent
Dangelewicz et al.

(10) Patent No.: US 10,960,690 B2
(45) Date of Patent: Mar. 30, 2021

(54) SHEET FED DEVICE

(71) Applicant: Hewlett-Packard Development Company, L.P., Houston, TX (US)

(72) Inventors: John A Dangelewicz, San Diego, CA (US); Bachu K Venkatesh, Bangalore (IN); Ivan Oong, Singapore (SG); Wei Lit Teoh, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 251 days.

(21) Appl. No.: 16/066,138

(22) PCT Filed: Apr. 27, 2016

(86) PCT No.: PCT/US2016/029571
§ 371 (c)(1),
(2) Date: Jun. 26, 2018

(87) PCT Pub. No.: WO2017/188945
PCT Pub. Date: Nov. 2, 2017

(65) Prior Publication Data

US 2020/0269613 A1 Aug. 27, 2020

(51) Int. Cl.

| | |
|---|---|
| ***B41J 13/10*** | (2006.01) |
| ***B65H 1/04*** | (2006.01) |
| *B41J 11/00* | (2006.01) |
| *B41J 29/393* | (2006.01) |

(52) U.S. Cl.
CPC ..... *B41J 13/103* (2013.01); *B65H 1/04* (2013.01); *B41J 11/009* (2013.01); *B41J 29/393* (2013.01); *B65H 2511/10* (2013.01); *B65H 2511/30* (2013.01)

(58) Field of Classification Search
CPC ..... B65H 2511/30; B65H 2511/10; B41J 13/0054; B41J 15/00; B41J 15/048; B41J 15/18; B41J 17/02; B41J 17/18; B41J 17/20; B41J 13/103; B41J 11/009; B41J 13/106; B41J 13/32
See application file for complete search history.

(56) References Cited

U.S. PATENT DOCUMENTS

| | | | |
|---|---|---|---|
| 4,929,844 | A | 5/1990 | Houjiyou et al. |
| 5,839,015 | A | 11/1998 | Faguy et al. |
| 6,497,179 | B1 | 12/2002 | Allen et al. |
| 6,585,341 | B1 | 7/2003 | Walker et al. |

(Continued)

FOREIGN PATENT DOCUMENTS

| | | | |
|---|---|---|---|
| CN | 104071607 | A | 10/2014 |
| JP | H05105265 | A | 4/1993 |
| JP | 2003182169 | A | 7/2003 |

OTHER PUBLICATIONS

OKI Data. The C831 Series from OKI: Bid Performance and Compact Design to Fit Your , Needs, Space and Budget ~ 2813 ~ 4 pages.

*Primary Examiner* — Kristal Feggins
(74) *Attorney, Agent, or Firm* — Dicke Billig & Czaja PLLC

(57) ABSTRACT

A sheet fed device having a media tray and a sensor assembly is disclosed. The media tray includes a major surface having a leading portion and a trailing portion. The sensor assembly is operably coupled to the media tray. The sensor assembly includes a detector spaced-apart from and movable relative to the media tray in a path laterally across the major surface between the leading portion and the trailing portion.

15 Claims, 5 Drawing Sheets

(56) References Cited

U.S. PATENT DOCUMENTS

| | | | |
|---|---|---|---|
| 6,619,656 | B2 | 9/2003 | Guddanti et al. |
| 7,715,734 | B2 | 5/2010 | Edwards et al. |
| 8,760,739 | B2 | 6/2014 | Golding et al. |
| 2005/0180797 | A1 | 8/2005 | Hattori |
| 2011/0135330 | A1 | 6/2011 | Honguh |
| 2013/0265361 | A1 | 10/2013 | Yatsunami |
| 2013/0292899 | A1 | 11/2013 | Mattern et al. |

SHEET FED DEVICE

BACKGROUND

Sheet fed devices—including printers, copiers, scanners, fax machines, multifunction devices, all-in-one devices, or other devices—produce images on media such as plain paper, photo paper, transparencies, and other media. In some examples, sheet fed devices can print on media stacks of metals and polymeric media, such as Compact Discs, in addition to or instead of broad and thin media. Media is positioned as a media stack in an input media tray. Images can be obtained directly from the sheet fed device or communicated to the sheet fed device from a remote location such as from a computing device or computing network. A sheet is selected from the media stack, typically one item at a time, and fed trough a printing mechanism along a feedpath to an output tray.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Sheet fed devices may include one or more media detection mechanisms to detect properties of the media in the media tray. For example, media properties may include whether media is present in the input tray, the size of the media in the media tray, and the type of media in the media tray. Sheet fed devices may also detect media-related properties such as whether the input tray is positioned in the sheet fed device whether media is present in the input tray or the amount of media present in the input tray.

At present, sensor and mechanisms to detect multiple media properties adversely affects costs and value in sheet fed devices. Low cost peripheral devices may not include detection mechanisms. Higher end sheet fed devices may include multiple sensors to address challenges in determining media properties, such as media size. Many types of sensors, such as electromechanical switches, can add substantial costs to sheet fed devices. Furthermore, some detection mechanisms, such as width detection mechanisms, are relatively poor proxies for media size and type.

Mobile, or remote access of sheet fed devices has placed a greater emphasis on media property detection. For example, users attempting to access sheet fed devices may be remote from the sheet fed device and thus cannot readily determine whether the input media tray includes the proper media by opening up the media tray to determine its contents. Additionally, remote access of sheet fed devices is often provided via third party software applications that may specify general conditions for media property detection. One popular third party software application for mobile printing specifies the sheet fed device determine media presence and media size in order for a user to access the device.

Figure 1A:
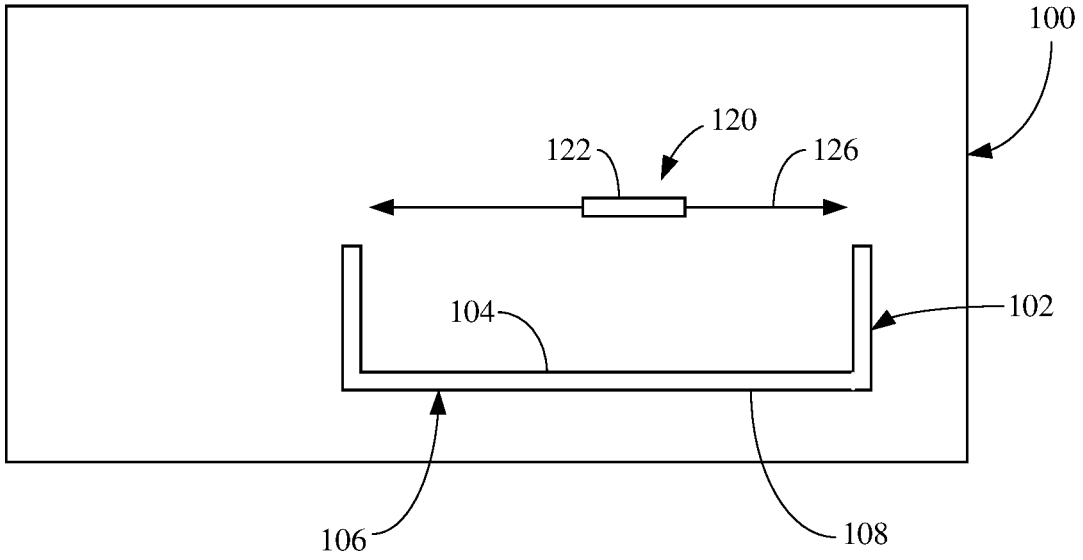
FIG. 1A is a schematic diagram illustrating an example sheet fed device.

FIG. 1A illustrates an example sheet fed device 100 having a media tray 102 and a sensor assembly 120. The media tray 102 includes a major surface 104 having a leading portion 106 and a trailing portion 108. The sensor assembly 120 is operably coupled to the media tray 102. The sensor assembly 120 includes a detector 122 spaced-apart from and movable relative to the media tray 102 in a path 126 laterally across the major surface 104 between the leading portion 106 and the trailing portion 108.

Figure 1B:
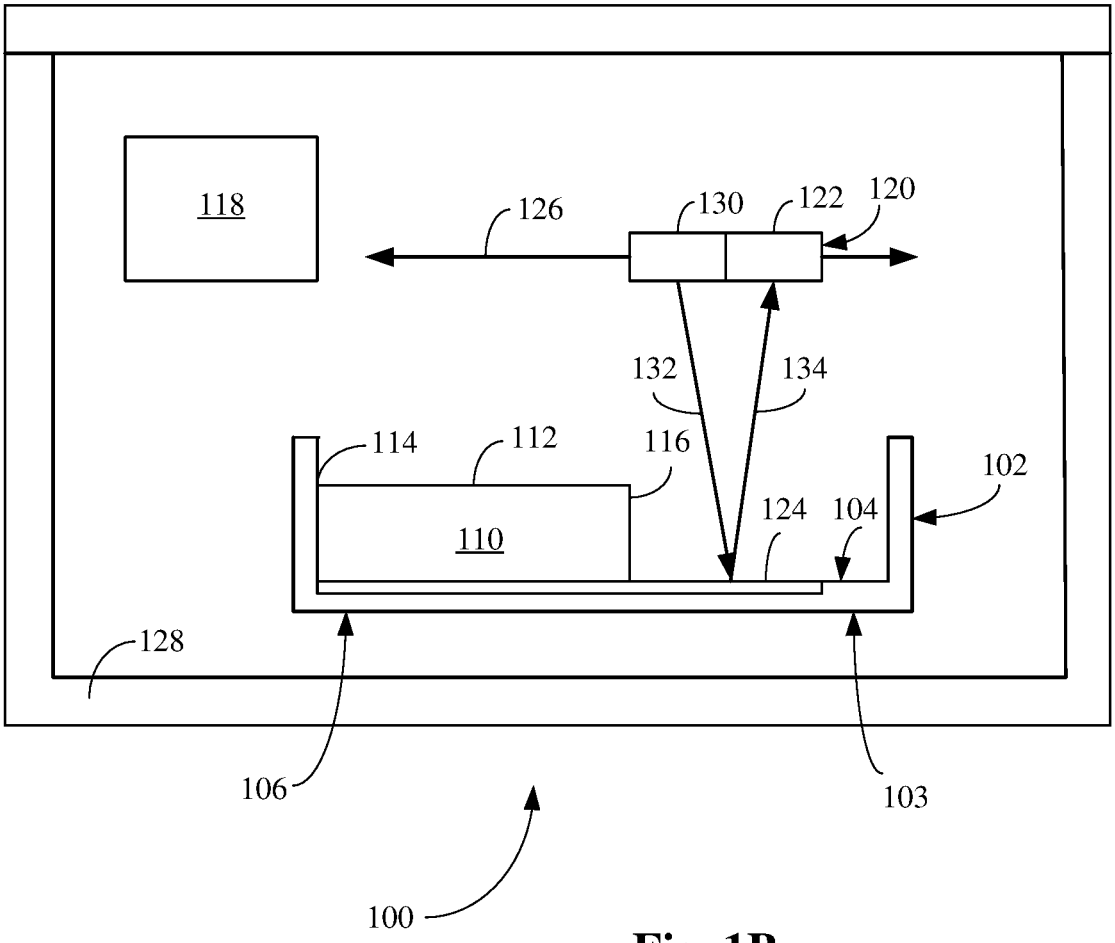
FIG. 1B is a schematic diagram illustrating an example sheet fed device of FIG. 1A.

FIG. 1B illustrates an example of sheet fed device 100. Exemplars of the example sheet fed device 100 can include one or combinations of two or more of a printer, scanner, copier, fax machine, finisher, or other devices. The sheet fed device may be operated as one or combinations of two or more of a stand alone device, a device coupled to a computer network, or a peripheral or auxiliary device operated by a computer or other processing device. The sheet fed device 100 includes a media tray 102 having a major surface 104 including a leading portion 106 and a trailing portion 108.

The media tray 102 can be used to support or include a media stack 110, such as a stack of one or more sheets of media. In one example, the media stack can lay on the major surface 104 of the media tray 102. The sheets of media in the media stack 110 include a major surface 112, a leading edge 114, and a trailing edge 116. In an example in which the sheet fed device 100 is a printer, a sheet of media is fed into a printer mechanism 118 leading edge 114 first for printing onto the major surface 112. In this example, the sheets of media in the media stack 110 can lay on the major surface 104 such that the leading edge 114 of the media stack 110 is on the leading portion 106 of the media tray 102 and the trailing edge 116 can lie on the trailing portion 108 of the media tray 102. As will be demonstrated, the edge of the media stack 110 in the leading portion 106 of the media tray 102 is considered to be the leading edge 114 of the media stack for descriptive purposes regardless of whether the media stack 112 is correctly positioned in the media tray 102 for operation of the sheet fed device 100.

The sheet fed device 100 further includes a sensor assembly 120 operably coupled to the media tray 102. In one example, the sensor assembly 120 includes a detector 122 spaced-apart from and movable relative to the media tray 102 and thus the media stack 112 when supported in the media tray 102. The detector 122 is movable in a path 126 laterally across the major surface 104 of the media tray 102 between the leading portion 106 and the trailing portion 108. By between the leading portion 106 and trailing portion 108, it is meant the detector 122 can move relative to the media tray 102 laterally across the major surface 104 in a direction from the leading portion 106 to the trailing portion 108 or in a direction from the trailing portion 108 to the leading portion 106 one or more times.

The sheet fed device 100 can include a chassis 128. In one example, the detector 122 can be fixed relative the chassis 128 and the media tray 102 can be movable, such as a media tray 102 motorized to move, relative the chassis 128 as the detector 122 is moved relative to the media tray 102 laterally across the major surface 104. In other examples, the media tray 102 can be held stationary relative the chassis 128 while the detector 122 is moved relative to the media tray 102 laterally across the major surface 104. In still another example, both the detector 122 and the media tray 102 are movable relative to the chassis 128 as the detector 122 is moved relative to the media tray 102 across the major surface 104.

In one example, the sensor assembly 120 includes a reflective portion 124 attached to the media tray 102, for example, on the major surface 104. The reflective portion 124 can include one or more reflective elements including diffusely reflective elements, specularly reflective elements, retro-reflective elements, or combinations of two or more types of reflective elements. The reflective portion 124 is configured to operate with the detector 122. In one example, the sensor assembly 120 includes an emitter 130 mechanically coupled to, such as fixed relative to, the detector 122. The emitter 130 emits a light including incident ray 132 that is directed toward the reflective portion 124. The reflective portion 124 can reflect the incident ray 132 back to the detector 122 as reflected ray 134. In some examples, the wavelength of the incident ray 132 and reflected ray 134 are not in the visible spectrum.

Figure 2:
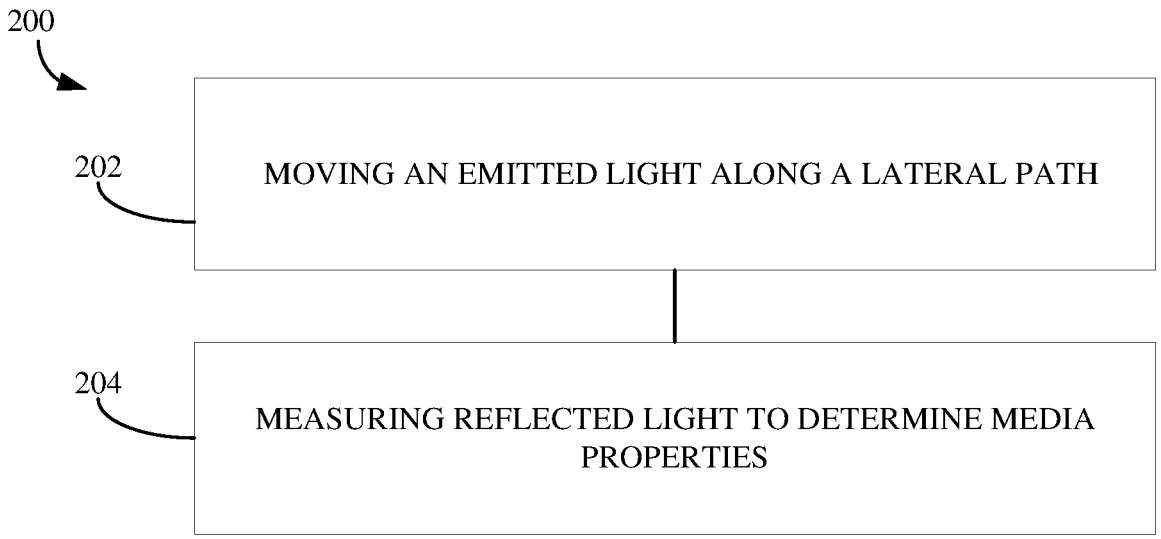
FIG. 2 is a block diagram illustrating an example method of the sheet fed device of FIG. 1A.

FIG. 2 illustrates an example method 200 of the sheet fed device 100 for detecting a media property of the media stack 110 in the media tray 102. An example media property can include dimensions of the major surface of the sheets in the media stack 110. Other examples of media properties include the type of media, i.e., whether the sheets are photo-paper, plain paper, or other type of media, height of the media stack 110, the presence of a media stack 110 in the media tray 102. Still further, the method 200 can be used to detect whether the media tray 102 is present in the sheet fed device 100.

In one example, the method 200 includes moving an emitted light, such as incident ray 132, along the lateral path 126 of the major surface 104 of the media tray 102 at 202. An amount of reflected light, such as reflected ray 134, at two or more locations along the lateral path 126 is measured to determine at least one media property including the dimensions of the major surface 112 of the media stack 110 at 204.

Figure 3:
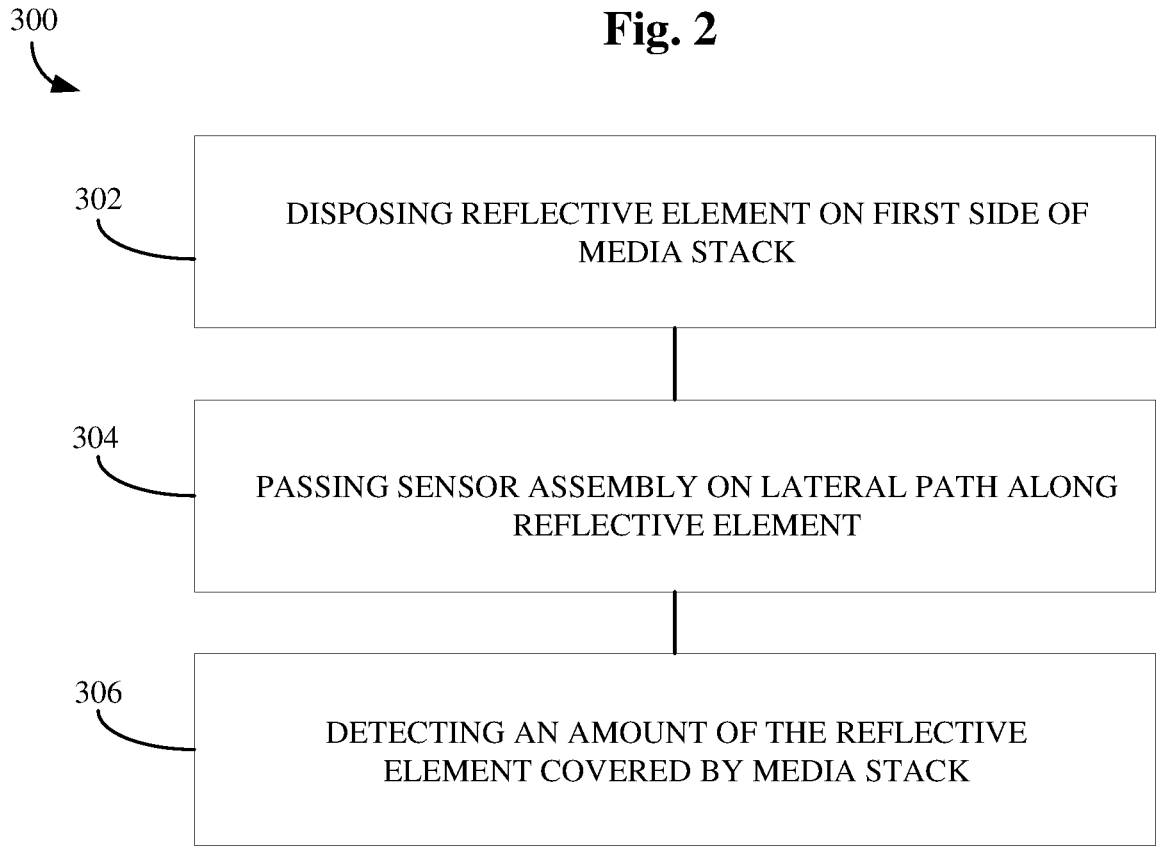
FIG. 3 is a block diagram illustrating another example method of the sheet fed device of FIG. 1A.

FIG. 3 is an example method 300 of the sheet fed device 100 for detecting a media property of the media stack 110 in the media tray 102. A reflective element is disposed on a first side of the major surface 112 of the media stack 110, such as on the major surface 104 of the media tray 102, at 302. The sensor assembly is passed on a lateral path 126 between the leading portion 106 and the trailing portion 108 of the media tray 102 at 304. The lateral path 126 is on a second side of the media stack 110, which is opposite the first side of the media stack 110. The sensor assembly 120 detects an amount of the reflective element covered by the media stack 110 at 306.

In one example, the dimensions of the major surface 112 of the media stack 110 are calculated based on the amount of the reflective element covered by the media stack 110 on the lateral path. In this example, the two dimensional size of the media stack 110 is determined based on the detection at 306 along a single dimension path 126, i.e., media stack length. In one example, the actual length of the media stack 110 along the path 126 is measured and the media stack length is based on the measurement. In another example, the length of the media stack 110 is determined from detecting which of a plurality of reflective elements 126 on the media tray 102 the media stack 110 covers. In each example, the determination can be based on comparing the amount of the reflective elements covered by the media stack at 306 against a table of known media dimensions.

Figure 4:
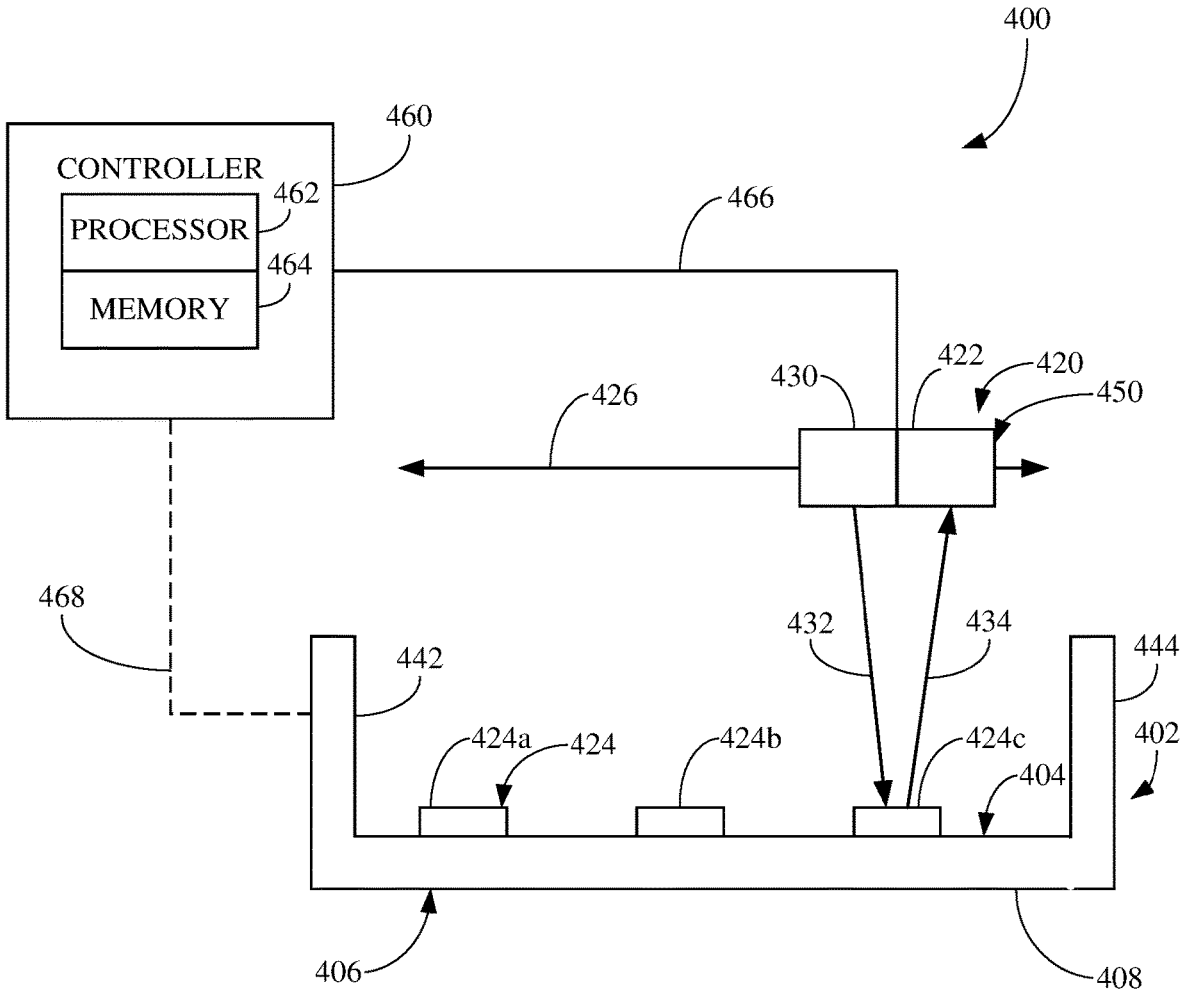
FIG. 4 is a schematic diagram illustrating a first view, such as a side view, of example of portion of the sheet fed device of FIG. 1A.

FIG. 4 illustrates an example first view, such as a side view, of an example portion of the sheet fed device 400, which can correspond with the sheet fed device 100. The portion of sheet fed device 400 includes a media tray 402 and sensor assembly 420. The media tray 402 includes a major surface 404, leading portion 406, and trailing portion 408. In the example, the media tray 402 includes a plurality of sidewalls 440, such as a leading sidewall 442 and trailing sidewall 444. The sensor assembly 420 includes a detector 422, emitter 430 mechanically coupled together in a sensor device 450. A plurality of reflective elements 424, such as reflective elements 424*a*, 424*b*, 424*c*, are attached to the major surface 404 of the media tray 402. The media tray 402 supports media stack 110.

In one example, the sensor device 450 is coupled to a controller 460 that can selectively operate the emitter 430 and receive a signal from the detector 422. Additionally, the controller 460 can cause the media tray 402 to move relative to the sensor device 450, receive a signal in which to base the relative position of the sensor device 450 to the media tray 402 on path 426, and perform other functions. The controller 460 can be any combination of hardware and software programming to implement the functionalities, including methods 200, 300, of the example, media property detection systems or sheet fed device. In one example, the controller 460 includes a processor device 462 and memory 464, that may be a stand alone, or separate hardware or part of the general processing hardware of the sheet fed device 400. Software programming may be processor executable instructions store on at least one non-transitory machine-readable storage medium, such as memory 464 and the hardware may include one or more processing resources to execute the instructions. In one example, a propagating signal by itself does not qualify as storage media. In some examples, the hardware may include electronic circuitry to at least partially implement at least some features of the methods 200, 300 or functions. The controller 460 can be operatively connected to the sensor device 450 and other features of the sheet fed device 400, such as motorized elements, to generate and receive signals, such as by electrical or optical conductors 466, 468 or other signal pathways.

Figure 5:
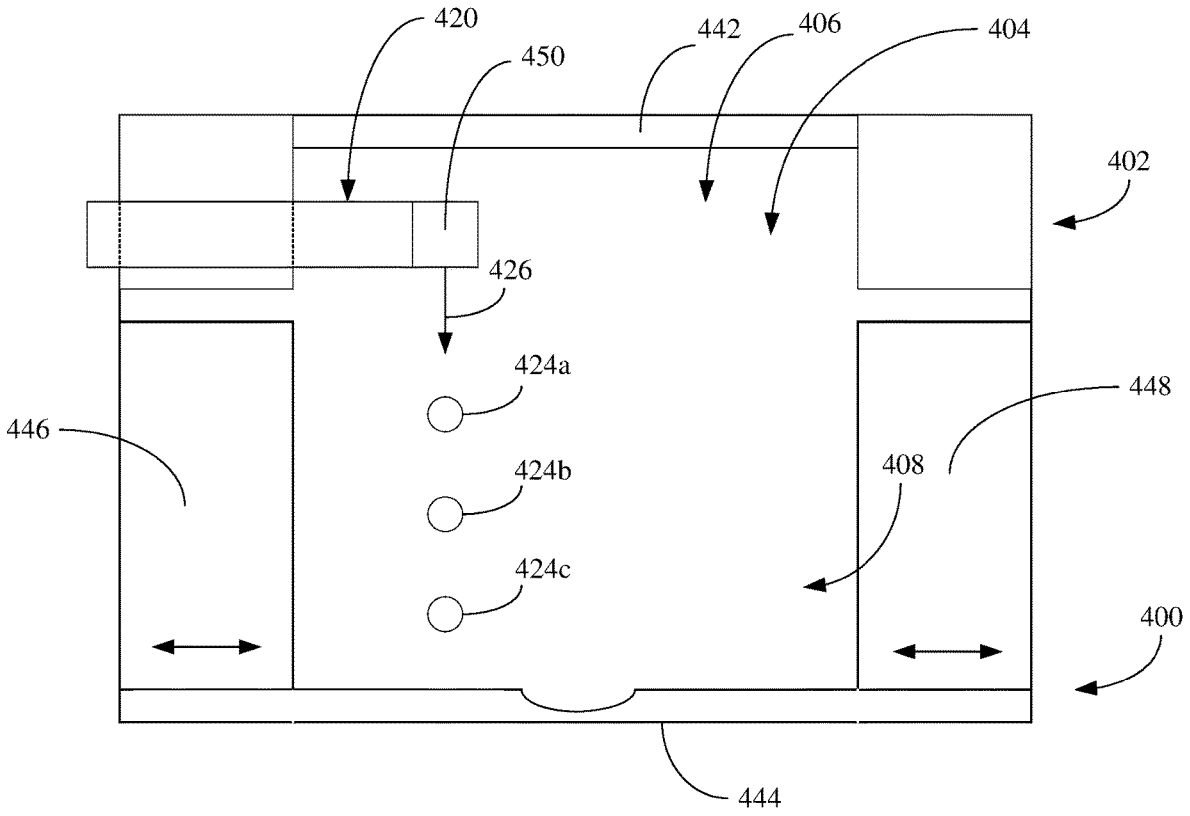
FIG. 5 is a schematic diagram illustrating a second view perpendicular to the first view, such as a top view, of the example of a portion of the sheet fed device of FIG. 4.

FIG. 5 illustrates an example second view generally perpendicular to the first view, such as a top view, of the example portion of the sheet fed device 400, depicting the media tray 402 underneath the sensor device 450. In the example top view, the media tray 402 does not include a media stack to depict the reflective elements 424 and the position of the reflective elements with respect to the sidewalls 442, 444, sensor device 450, and lateral path 426. The lateral path 426 depicts the position of the sensor device 450 with respect to the media tray 402, such as the sensor device above major surface 404, as the sensor device 450 moves with respect to the media tray 402. The example media tray 402 of FIG. 5 can also include adjustable sidewalls 446, 448.

In one example the sensor device 450 includes a retro-reflective edge detection interrupter sensor, or REDI sensor. The emitter 430 in the REDI sensor is a light emitting diode that generates a directed light including incident ray 432.

The detector 422 of sensor device 450 detects the presence or absence of a reflected ray 434. The sensor device 450 can be configured to operate with reflective elements 424. In one example, the reflective elements 424 can include a highly reflective, or mirror-like, specularly reflective viewing surface facing the detector 422 and emitter 430. Examples of specularly reflective viewing surfaces can include aluminum or vaporized aluminum.

In another example, the reflective elements 424 can include a retro-reflective sheeting having a retro-reflective viewing surface facing the detector 422 and emitter 430. Retro-reflective materials are configured to receive light rays impinging upon the viewing surface and so alter the rays to reflect back toward the light source. Two examples of retro-reflective materials include microsphere-based sheeting and cube corner sheeting. Microsphere-based sheeting includes a multitude of microspheres typically at least partially imbedded in a binder layer and having associated specular or diffuse reflecting materials (e.g., pigment particles, metal flakes, vapor coats) to retro-reflect incident light. Cube corner retro-reflective sheeting comprises a body portion typically having a substantially planar viewing surface and a structured surface comprising a plurality of cube corner elements. Each cube corner element comprises three approximately mutually perpendicular optical faces that intersect at a cube apex. The cube corner elements can be treated with a specularly reflective coating, such as vaporized aluminum, or gapped with air permit total internal reflection.

The reflective elements, whether specularly reflective, retro-reflective, or otherwise, can be formed in a selected size and shape and selectively disposed on the major surface 404 of the media tray 402, such as underneath the path 426, so as to selectively reflect light from the emitter 430 back to the detector 422. In one example, the reflective elements can include an undersurface, opposite the viewing surface, that includes a pressure-sensitive adhesive to affix the reflective elements 424 to the major surface 404.

As the sensor device moves along path 426 with respect to the media tray 402, and in particular, with respect to the reflective elements 424, the controller 460 can selectively generate an incident ray 432 with emitter 430 (in one example, the emitter is turned on as the sensor device moves along path 426). If the incident ray 432 reaches a reflective element 424, the incident ray 432 is reflected back to the detector 422 of REDI sensor as reflected ray 434 indicating that a particular reflective element 424 is exposed or the reflective element 424 is exposed in the particular section of the path 126. If, however, the media stack 110 obscures the reflective element 424, no reflected ray will be returned to the sensor device (or any diffusely reflected ray reaching the detector 422 will have such low power or energy as to be either undetected by the detector 422 or disregarded by the controller 460).

In either case, the presence or absence of a detected reflected ray 432 at a selected position along path 426 is communicated to the controller 460 such as via a signal that can be applied to determine media properties of the media stack. In one example, the position of the sensor device 450 with respect to the media tray 402 can be determined by tracking the movement of a motorized tray 402 or motorized sensor device 450 (the sensor device can be disposed in a motorized carriage, such as mechanical elements of a scanner carriage). In another example, the position of the sensor device 450 with respect to the media tray 402, or in particular the reflective element 424, can be determined by the reflective element. The reflective element 424 can alter the characteristics of the incident ray 432, such as wavelength or polarization, to distinguish the characteristics of the reflected ray for each of the reflective elements 424*a*, 424*b*, 424*c*.

In one example, the media tray 402, and thus sheet fed device 400, can be configured to accept one or more of a set different, predetermined media sizes of varying lengths and widths. The measurement of the width, as based on the presence and/or absence of reflected rays 432 at various points along path 426 can be used to inferentially determine the media size of the media stack 110, i.e., length of the media stack 110 can be a proxy for two-dimensional size of the media stack.

One particular example is provided with reference to FIG. 5. Media tray 402 can be configured to accept three different two-dimensional sizes of media including 4 inch by 5 inch (4×5) photo stock, 4 inch by 6 inch (4×6) photo stock, and 5 inch by 7 inch (5×7) photo stock. The leading edge 112 of media stack 110 abutted against the leading sidewall 442 will be accepted into a printing mechanism.

The reflective elements 424 are selectively positioned on the major surface 404 to accommodate detection of the three sizes of media and interact with the sensor device 450. Reflective element 424*a* is attached to the major surface 404 so as to be between 4 inches and 5 inches, such as 4.5 inches, from the leading sidewall 442. Reflective element 424*b* is attached to the major surface 404 so as to be between 5 inches and 6 inches, such as 5.5 inches, from the leading sidewall 442. Reflective element 424*c* is attached to the major surface 404 so as to be between 6 inches and 7 inches, such as 6.5 inches, from the leading sidewall 442.

As the sensor device 450 moves along path 426 with respect to the media tray 402, the presence or absence of a reflected ray at the positions of reflective elements is determined.

If, for example, no reflected ray is detected, from reflective elements 424*a*, 424*b*, 424*c*, the controller can determine, such as via table look up, that the media stack 110 in media tray is 5×7 photo stock.

If, for example, no reflected ray is detected from reflective elements 424*a*, and 424*b*, but a reflected ray is detected from reflective element 424*c*, the controller can determine, such as via table look up, that the media stack 110 in media tray is 4×6 photo stock.

If, for example, no reflected ray is detected from reflective element 424*a*, but a reflected ray is detected from reflective elements 424*b* and 424*c*, the controller can determine, such as via table look up, that the media stack 110 in media tray is 4×5 photo stock.

If, for example, a reflected ray is detected from reflective elements 424*a*, 424*b*, and 424*c*, the controller can determine, such as via table look up, that the media stack 110 in media tray is incorrectly place 4×5 photo stock. The controller can then provide an alert for a user to change the orientation of the 4×5 media. In this case, the presence of a media stack 110 can be verified by another sensor or an additional reflective element positioned closer to the leading sidewall 442 than reflective element 424*a*.

Other configurations of the media tray 402 including the positioning of the reflective elements 424 to accept other two-dimensional sizes are contemplated. For instance, the media tray 402 can be configured to accept L (3.5 inch by 5 inch) and 2L (5 inch by 7 inch) media. This example can include two reflective elements on the major surface, such as a first reflective element positioned between 3.5 inches and 5 inches, such as 4.25 inches, from the leading sidewall 442 and a second reflective element positioned between 5 inches and 7 inches, such as 6 inches, from the leading sidewall 442. Based on whether a reflected ray is detected from each of the first and second reflective elements, the controller can determine, such as via table look up, whether the size of the media is L, 2L, or incorrectly oriented L sized media.

In an alternative to discrete, selectively positioned reflective elements 424*a*, 424*b*, 424*c* positioned on the media tray 402, the reflective element 424 can include a continuous strip of reflective material, such as specularly reflective material, retro-reflective material, or diffusely reflective material that can be in contrast to the media stack 110. In this example, the detector 422 can detect a reflected ray or change in contrast with the material in combination with a position of the sensor device 450 along path 426, such as a servo encoder position of a motorized media tray or motorized sensor device carriage. The encoder position is used to determine the media length, which can be used as a proxy to determine two dimensional media size or media type. Additionally, no change in state of detector can indicate that a media stack is not present in the media tray 402.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A sheet fed device, comprising:

a media tray including a major surface having a leading portion and a trailing portion, the media tray to receive a stack of media on the major surface of the media tray; and a sensor assembly operably coupled to the media tray, the sensor assembly including a detector spaced-apart from and movable relative to the media tray in a lateral direction across the major surface between the leading portion and the trailing portion, the sensor assembly to detect an amount of the major surface covered by the stack of media and determine a two-dimensional size of the media on the major surface.

2. The sheet fed device of claim 1, wherein the sensor assembly includes a reflective portion attached to the media tray.

3. The sheet fed device of claim 2, wherein the reflective portion includes a plurality of specularly reflective or retro-reflective elements.

4. The sheet fed device of claim 2 wherein the sensor assembly includes an emitter mechanically coupled to the detector.

5. The sheet fed device of claim 1 comprising a chassis wherein the media tray is motorized to move relative the chassis.

6. The sheet fed device of claim 5 wherein the detector is fixed relative the chassis.

7. The sheet fed device of claim 1 wherein the sensor assembly includes a diffusely reflective element in contrast to a media stack in the media tray.

8. A method of detecting a media property of a media stack in a sheet fed device, the method comprising:

disposing a reflective element on a first side of the media stack in a media tray having a major surface including a leading portion and a trailing portion;

passing a sensor assembly on a lateral path between the leading portion and the trailing portion along the reflective element on a second side opposite the first side of the media stack;

detecting an amount of the reflective element covered by the media stack on the lateral path of the sensor assembly; and determining the dimensions of the media stack on the major surface from the measured amount of the reflected element covered along the lateral path.

9. The method of claim 8 comprising calculating dimensions of the media stack based on the amount of the reflective element covered by the media stack on the lateral path.

10. The method of claim 8 wherein passing the sensor assembly includes receiving an amount of reflected light with the sensor assembly.

11. The method of claim 10 comprising measuring the amount of reflected light at a plurality of locations along the lateral path.

12. The method of claim 8 wherein passing the sensor assembly includes emitting a light with the sensor assembly.

13. A method of detecting a media property of a media stack, the method comprising:

receiving a stack of media onto a major surface of a media tray;

moving an emitted light relative the media tray along a lateral path of the major surface between a leading and edge and a trailing edge of the media tray along the stack of media; and measuring an amount of reflected light from the emitted light at a plurality of locations along the lateral path; and determining the dimensions of the stack of media on the major surface from the measured amount of reflected light along the lateral path.

14. The method of claim 13 comprising determining a media type from the amount of reflected light.

15. The method of claim 13 comprising measuring a height of the media stack from the amount of reflected light.

* * * * *